US009950536B2

(12) United States Patent
Inoue

(10) Patent No.: US 9,950,536 B2
(45) Date of Patent: Apr. 24, 2018

(54) LIQUID SUPPLY MECHANISM AND LIQUID EJECTING APPARATUS

(71) Applicant: Seiko Epson Corporation, Tokyo (JP)

(72) Inventor: Ken Inoue, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/298,718

(22) Filed: Oct. 20, 2016

(65) Prior Publication Data

US 2017/0106658 A1 Apr. 20, 2017

(30) Foreign Application Priority Data

Oct. 20, 2015 (JP) ..... 2015-206142

(51) Int. Cl.
*B41J 2/175* (2006.01)

(52) U.S. Cl.
CPC ..... *B41J 2/17506* (2013.01); *B41J 2/17509* (2013.01)

(58) Field of Classification Search
CPC ..... B41J 2/17513; B41J 2/17596; B41J 2/17556; B41J 2/17509; B41J 2/175; B41J 2/17566; B41J 2/1752; B41J 2/17503; B41J 2/14233; B41J 2/17506; B41J 2/161
USPC ..... 347/6, 7, 84–86, 89
See application file for complete search history.

(56) References Cited

U.S. PATENT DOCUMENTS

2012/0127244 A1 5/2012 Suzuki

FOREIGN PATENT DOCUMENTS

| | | |
|---|---|---|
| JP | 55-167589 U | 12/1980 |
| JP | 07-014179 U | 3/1995 |
| JP | 2012-111096 A | 6/2012 |

*Primary Examiner* — Jannelle M Lebron
(74) *Attorney, Agent, or Firm* — Nutter McClennen & Fish LLP; John J. Penny, Jr.

(57) ABSTRACT

A liquid supply mechanism includes a sub-tank that supplies liquid to a liquid ejection head and a liquid replenishing mechanism that suctions liquid from a main tank into the sub-tank. The liquid replenishing mechanism has a diaphragm, a biasing member, and a drive member. The diaphragm has a movable portion and a mounting portion and closes one end of a liquid container chamber provided on the sub-tank. The biasing member biases the diaphragm in a first direction in which a volume of the liquid container chamber is decreased. The drive member pulls the diaphragm in a second direction in which the volume of the liquid container chamber is increased. The movable portion of the diaphragm can move in the first direction and the second direction. The movable portion has a first portion, which is flexible, and a second portion that retains its shape when the liquid container chamber is pressurized.

7 Claims, 9 Drawing Sheets

LIQUID SUPPLY MECHANISM AND LIQUID EJECTING APPARATUS

BACKGROUND

1. Technical Field

The present invention relates to a liquid supply mechanism that supplies liquid to a liquid ejection head through a sub-tank of which the volume is changed in response to deformation of a diaphragm, and a liquid ejecting apparatus including the liquid supply mechanism.

2. Related Art

An ink supply mechanism that has main tanks such as ink cartridges and sub-tanks mounted on a carriage together with an ink jet head is known as an example of an ink supply mechanism of an ink jet printer. The sub-tanks are replenished with ink from the main tanks and the ink is supplied from the sub-tanks to the ink jet head during printing. JP-A-2012-111096 discloses an ink jet printer, or a liquid ejecting apparatus, that includes an ink supply mechanism, or a liquid supply mechanism, of this type.

In the ink supply mechanism in JP-A-2012-111096, a diaphragm pump is provided on the top of the sub-tanks. The pump includes a diaphragm that closes the top end of each sub-tank and a piston that is connected to the diaphragm. When the piston is pulled up through a rocking lever, the volume of the sub-tank is increased, thereby causing a negative pressure state. Ink is then suctioned into the sub-tank. When the lever is released after ink replenishment and the piston is allowed to move freely, the piston is pushed down by the pressing force of a pressure spring, thereby causing a pressurized state inside the sub-tank. Thus, pressurized ink can be supplied from the sub-tank to the ink jet head.

In the ink supply mechanism in JP-A-2012-111096, the piston connected to the diaphragm moves up or down to increase or decrease the volume of the sub-tank. If the diaphragm is deformed into an unintended shape, inconveniences may occur. For example, when the piston is pushed down by the force of the pressure spring after ink replenishment, pressurized ink presses the diaphragm upward on the outer peripheral side of the piston. At this time, if the diaphragm expands upward, the piston is lowered by a corresponding amount. However, the amount of ink that can be suctioned at one time by a pump of this type corresponds to a difference in height for the piston. A lowered piston indicates that the amount of ink that can be suctioned at one time is reduced. In other words, if the diaphragm expands upward, there may be a disadvantage that an ink replenishing amount is reduced.

When the diaphragm excessively bends as a result of radially expanding outward by pressurized ink, the diaphragm does not form a normal rolled shape, and the bent portion of the diaphragm enters and is caught between the piston and a cylinder. As a result, the piston may lock. In addition, such a state of being caught may shorten the life of the diaphragm or cause poorly pressurized ink.

SUMMARY

An advantage of some aspects of the invention is that it reduces the possibility of a diaphragm being deformed into an unintended shape in a diaphragm pump which suctions liquid such as ink into a sub-tank of a liquid supply mechanism.

A liquid supply mechanism according to an aspect of the invention includes a sub-tank that supplies liquid to a liquid ejection head and a liquid replenishing mechanism that suctions liquid from a main tank into the sub-tank. The liquid replenishing mechanism has a diaphragm that closes one end of a liquid container chamber provided on the sub-tank, a biasing member that biases the diaphragm in a first direction in which the volume of the liquid container chamber is decreased, and a drive member that pulls the diaphragm in a second direction in which the volume of the liquid container chamber is increased. The diaphragm includes a movable portion that is movable in the first direction and in the second direction, and a mounting portion that is secured to the sub-tank. The movable portion has a first portion, which is flexible, and a second portion that retains its shape when the liquid container chamber is pressurized.

According to the aspect of the invention, the first portion of the diaphragm is flexible, but the second portion of the diaphragm is configured to retain its shape even when the liquid container chamber is pressurized. This configuration can reduce the possibility of the diaphragm being deformed into an unintended shape. For example, the configuration can reduce the possibility of unintended lowering of the piston. This lowering may be caused as a result of the diaphragm being expanded upward when the liquid container chamber is pressurized by liquid replenishment. The configuration can also reduce the possibility of causing a state in which the diaphragm bends to form an unintended shape and is caught between the piston and a side wall portion of the sub-tank.

In the liquid supply mechanism, it is preferable that the second portion be a thick portion that is thicker than the first portion. This simple configuration can prevent deformation of the diaphragm.

In the liquid supply mechanism, it is preferable that the thick portion be provided in a center region of the diaphragm and that the first portion extend in the first direction from an outer peripheral edge of the thick portion. In this configuration, since the diaphragm is less likely to expand in the second direction, the possibility of the unintended lowering of the piston can be reduced. Moreover, since the diaphragm is less likely to expand radially outward, this configuration can reduce the possibility of causing a state in which the diaphragm enters and is caught between the piston and the side wall portion of the sub-tank.

In the liquid supply mechanism, the second portion may have a membrane portion, which is flexible, and a shape-retaining member that covers the membrane portion. This configuration can retain the shape of the second portion merely by adding the shape-retaining member without changing the membrane thicknesses of the first portion and the second portion.

In the liquid supply mechanism, it is preferable that the liquid supply mechanism include a support member that supports the center region of the diaphragm from inside the liquid container chamber, that the second portion extend along the surface of the support member, and that a gap to accommodate the first portion, which is loosened to form a projected shape in the first direction, be provided between the outer peripheral edge of the support member and an inner circumferential surface of the sub-tank. By using the foregoing support member, the shape of the diaphragm can be stabilized and the diaphragm can be deformed easily into an intended shape.

In the liquid supply mechanism, it is preferable that the liquid replenishing mechanism have a piston that is connected to the diaphragm and an elastically deformable member that interconnects between the piston and the drive member. It is preferable that the biasing member be a pressure spring that biases the diaphragm in the first direction by use of the piston. Preferably, the drive member is a lever that is capable of rocking in a specific rocking direction in which the lever pulls the diaphragm in the second direction by use of the piston and the elastically deformable member and in a direction opposite thereto. This configuration can replenish the sub-tank with liquid by driving the lever. When the lever is released, pressurized liquid can be supplied to the liquid ejection head by the biasing force of the pressure spring.

In the liquid supply mechanism, it is preferable that the liquid replenishing mechanism have a motor and a pressing mechanism that presses the lever in the specific rocking direction in accordance with an output rotation of the motor. This configuration can appropriately replenish the sub-tank with liquid at a desired timing by driving the motor.

A liquid ejecting apparatus according to another aspect of the invention includes the above liquid supply mechanism and a liquid ejection head that ejects liquid that is supplied from the liquid supply mechanism.

BRIEF DESCRIPTION OF THE DRAWINGS

The invention will be described with reference to the accompanying drawings wherein like numbers reference like elements.

DESCRIPTION OF EXEMPLARY EMBODIMENTS

Embodiments of a liquid ejecting apparatus and its liquid supply mechanism according to the invention are described with reference to the accompanying drawings. A liquid ejecting apparatus and a liquid supply mechanism according to an aspect of the invention are applications of the invention to an ink jet printer, which performs printing by ejecting ink from an ink jet head, and its ink supply mechanism.

Ink Jet Printer

Figure 1:
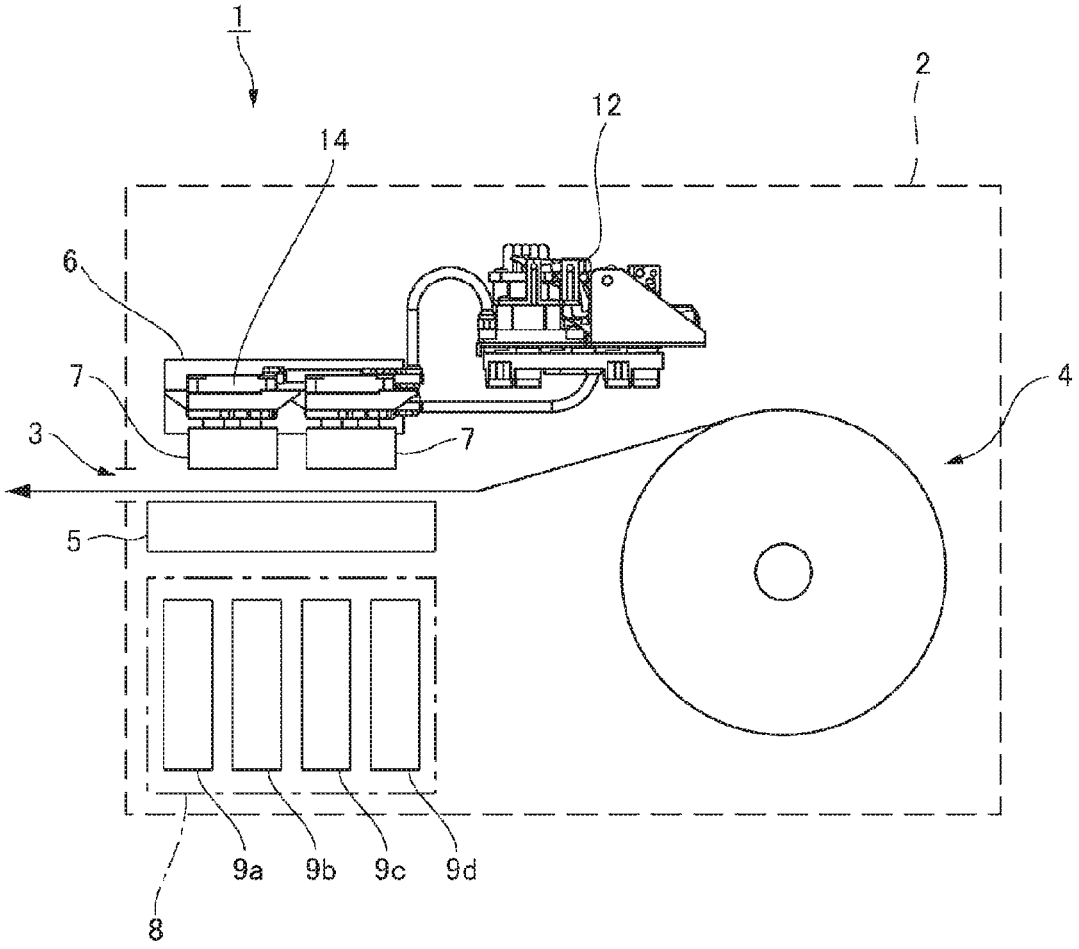
FIG. 1 illustrates the general configuration of an ink jet printer according to an embodiment of the invention.

FIG. 1 illustrates the general configuration of an ink jet printer according to an embodiment of the invention. An ink jet printer 1 (hereinafter, referred to as printer 1) performs printing onto continuous recording medium that is fed out from roll paper by using a plurality of types of color ink. The printer 1 has a printer case 2, which is formed like a rectangular prism as a whole. A recording paper exit 3 is formed in the front of the printer case 2; a roll paper compartment 4 is provided inside the printer case 2 near the back end of the printer. Recording paper that is fed out from the roll paper loaded in the roll paper compartment 4 is transported horizontally along a recording paper transport path via the surface of a platen 5, which is provided immediately to the rear of the recording paper exit 3.

A carriage 6 and an ink jet head 7 (a liquid ejection head) mounted thereon are disposed above the platen 5. The carriage 6 is supported by a carriage guide mechanism (not shown) to be movable in upward and downward directions. In accordance with the carriage 6 moving upward or downward, the ink jet head 7 is movable to a printing position at which a predetermined gap is formed with respect to the recording paper that passes over the surface of the platen 5 or to a retracted position that is retracted above the printing position. The printer 1 transports, across the surface of the platen 5, the recording paper that is fed out from the roll paper by a recording paper transport mechanism (not shown), and performs, in conjunction with this transport operation, printing onto the recording paper by ejecting ink from the ink jet head 7.

An ink cartridge loading section 8 is provided below the platen 5. In the ink cartridge loading section 8, ink cartridges 9*a* to 9*d* (main tanks) that respectively store the following four colors of ink are installed: cyan, magenta, yellow and black. When the ink cartridges 9*a* to 9*d* are installed in the ink cartridge loading section 8, ink supply needles (not shown) that are provided at the back of the ink cartridge loading section 8 are inserted into ink supply ports (not shown) that are provided on the back end of each of the ink cartridges 9*a* to 9*d*. Thus, the ink cartridges 9*a* to 9*d* are connected to an upstream end of an ink supply route 10 (see FIG. 2) to supply ink to the ink jet head 7.

A diaphragm pump unit 12 is disposed in the rear of the carriage 6 and the ink jet head 7. The diaphragm pump unit 12 has sub-tanks 11*a* to 11*d* that respectively store four colors of ink: cyan, magenta, yellow and black. A damper unit 14 with pressure adjustment chambers 13*a* to 13*d* is disposed above the ink jet head 7.

Figure 2:
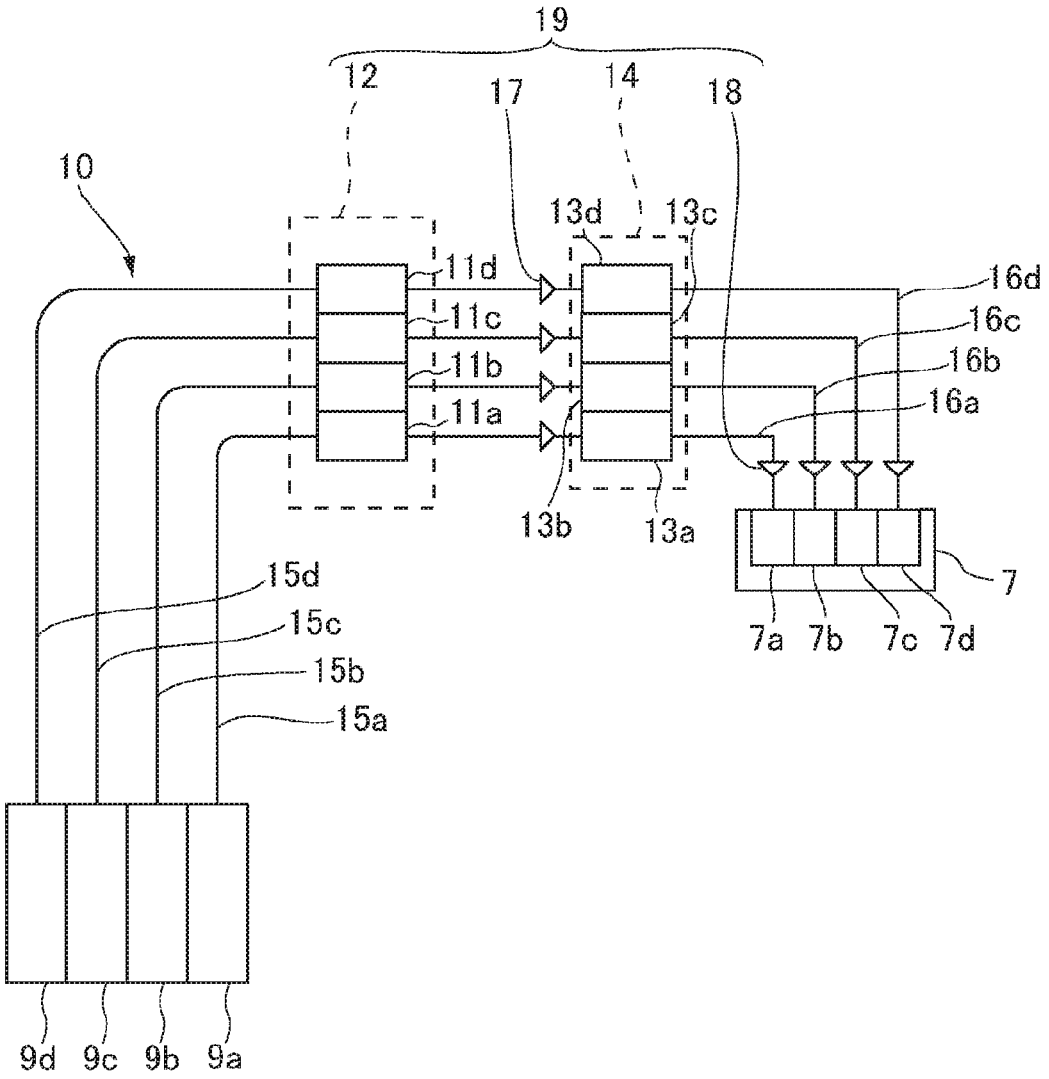
FIG. 2 schematically illustrates an ink supply system in the ink jet printer.

FIG. 2 schematically illustrates an ink supply system in the ink jet printer 1. The upstream side of the ink supply route 10 is composed of four channels of ink flow paths 15*a* to 15*d* to make connections between the ink cartridges 9*a* to 9*d* and the sub-tanks 11*a* to 11*d*. Ink in the ink cartridges 9*a* to 9*d* passes along the ink flow paths 15*a* to 15*d* and is suctioned into the sub-tanks 11*a* to 11*d* by an ink suction operation of the diaphragm pump unit 12, which is described later. The suctioned ink is then temporarily stored in the sub-tanks 11*a* to 11*d* before being sent out to the ink jet head 7. On the other hand, the downstream side of the ink supply route 10 is composed of four channels of ink flow paths 16*a* to 16*d* to make connections between the sub-tanks 11*a* to 11*d* and intra-head flow paths 7*a* to 7*d*.

The ink flow paths 16*a* to 16*d*, having the damper unit 14 provided thereon, are provided with check valves 17 on the upstream side of the damper unit 14. In addition, the ink flow paths 16*a* to 16*d* are provided with other check valves 18 on the upstream side of the ink jet head 7. Ink stored in the sub-tanks 11*a* to 11*d* passes through the check valves 17 and is supplied to the pressure adjustment chambers 13*a* to 13*d* of the damper unit 14. From the pressure adjustment chambers, the ink then passes through the check valves 18 and is supplied to the intra-head flow paths 7*a* to 7*d* of the ink jet head 7. The diaphragm pump unit 12, the damper unit 14, and the check valves 17 and 18 provided on the ink flow paths through these units constitute an ink supply mechanism 19 (the liquid supply mechanism) that supplies ink in the ink cartridges 9*a* to 9*d* to the ink jet head 7.

Diaphragm Pump Unit

Figure 3:
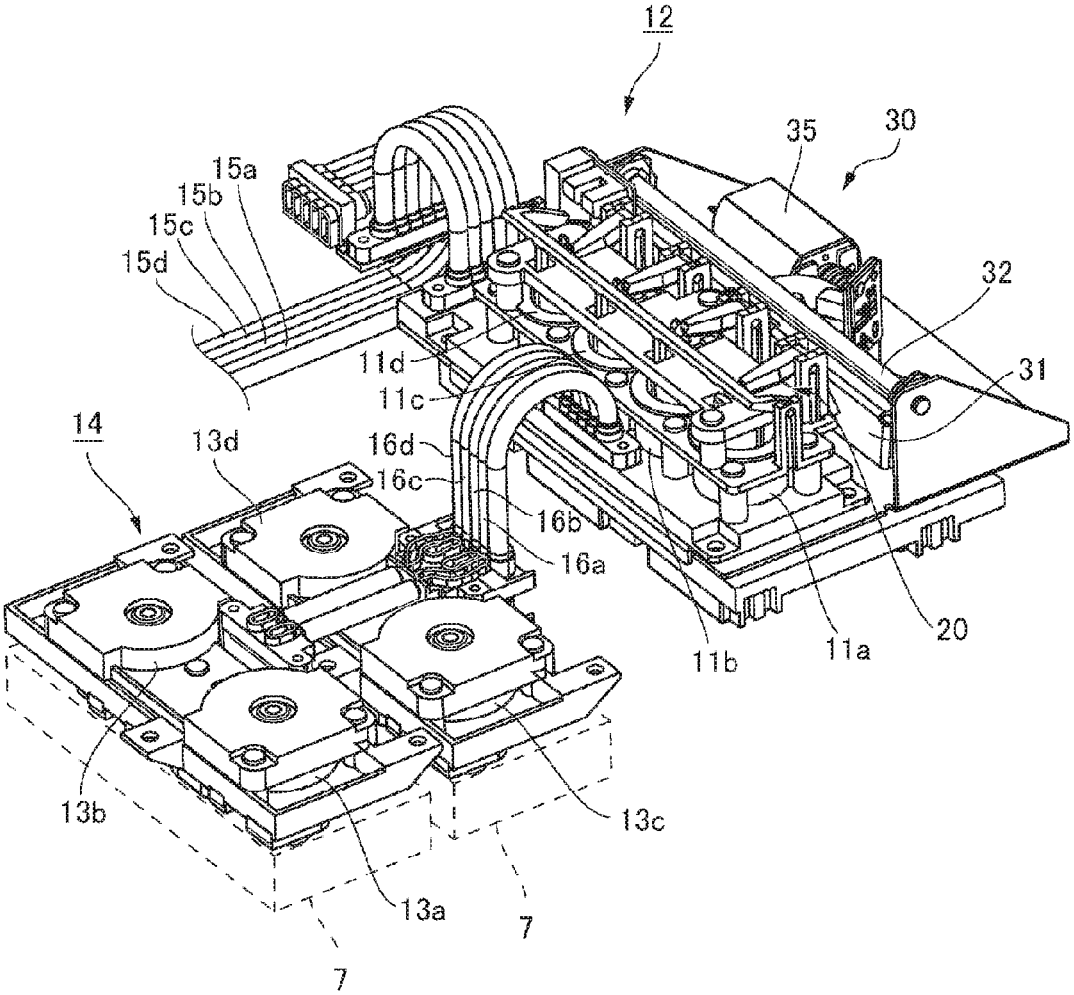
FIG. 3 is a perspective view of sub-tanks, a diaphragm pump unit, and a damper unit according to the embodiment.
Figure 4:
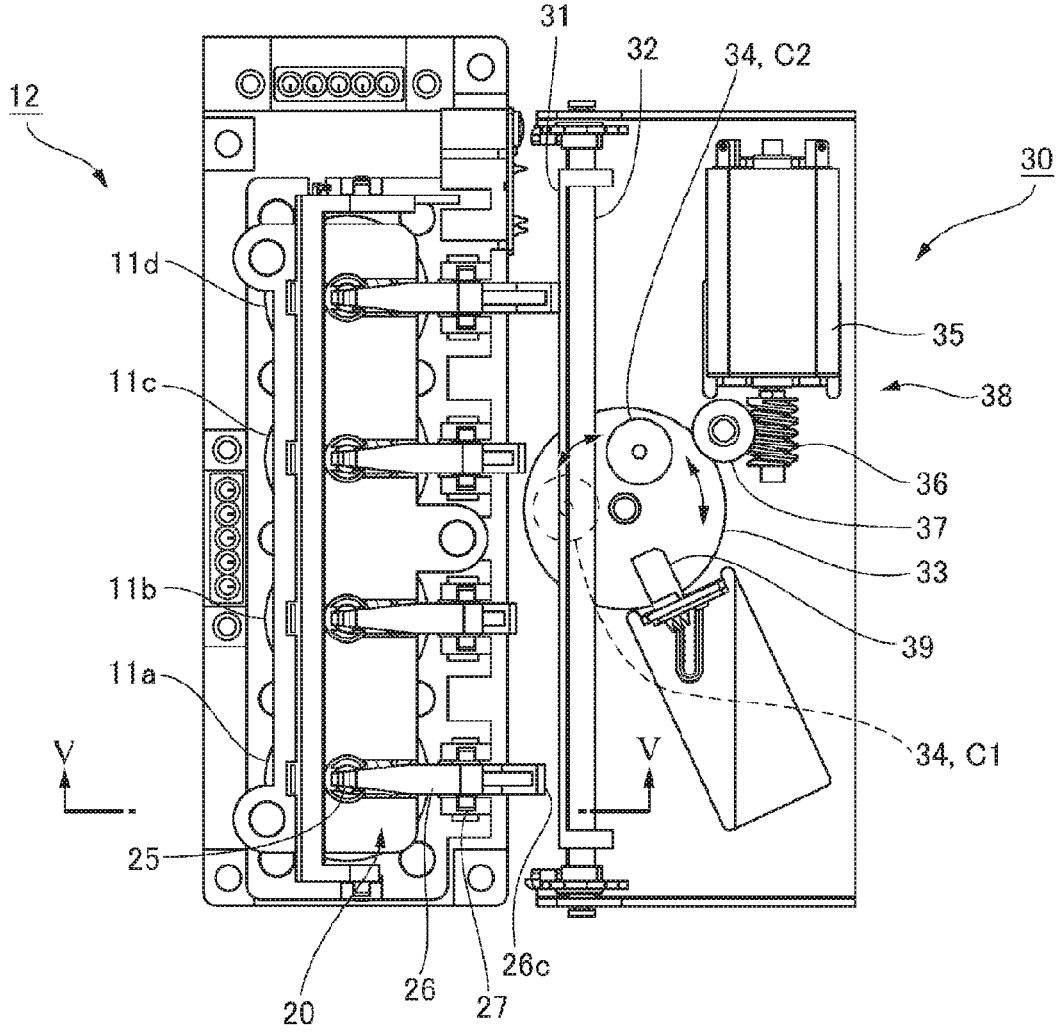
FIG. 4 is a plan view of the sub-tanks and the diaphragm pump unit.
Figure 5:
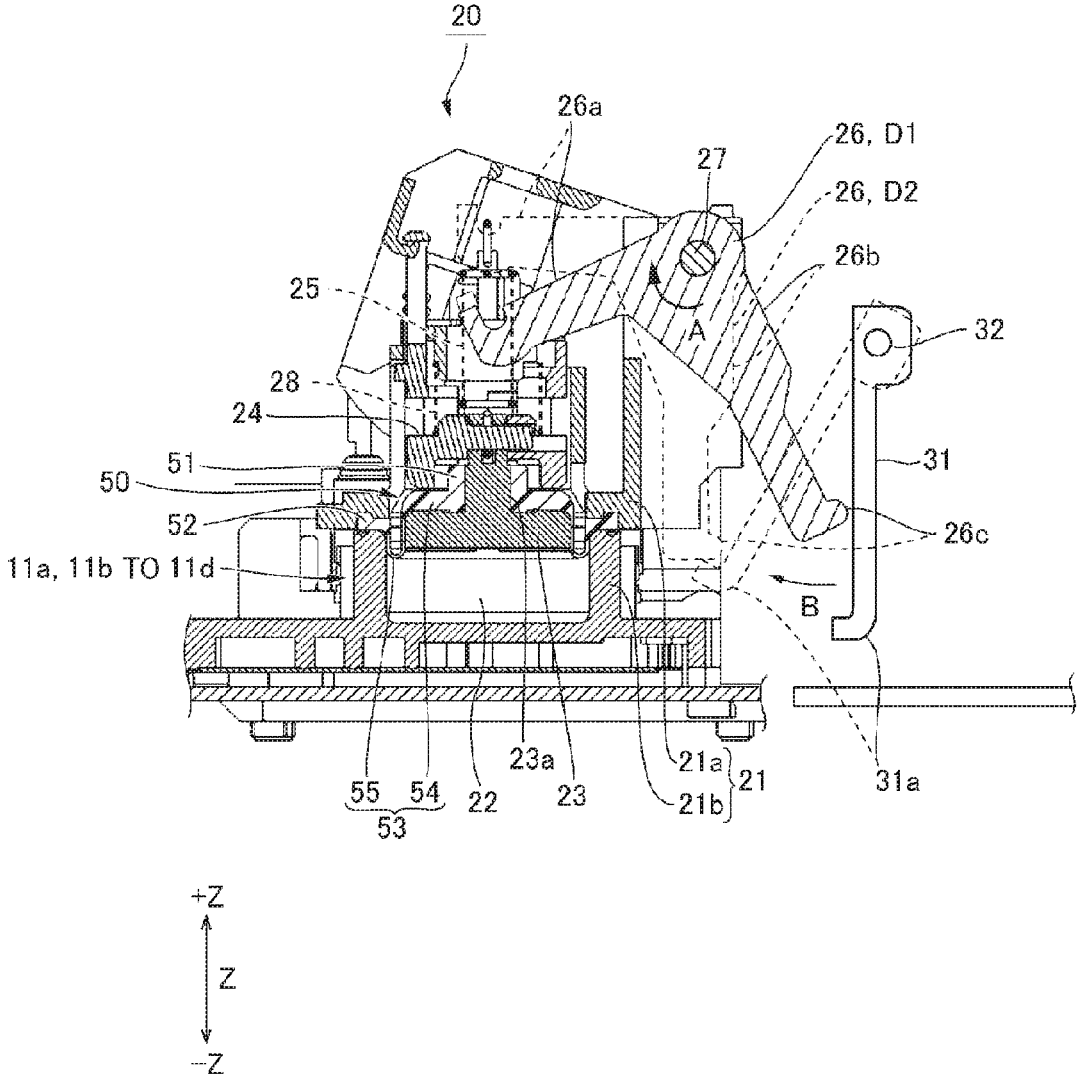
FIG. 5 is a sectional view taken along line V-V in FIG. 4 and illustrates the main parts of the diaphragm pump unit.

FIG. 3 is a perspective view of the diaphragm pump unit 12 including the sub-tanks and the damper unit 14. FIG. 4 is a plan view of the diaphragm pump unit 12 including the sub-tanks. FIG. 5 is a sectional view taken along line V-V in FIG. 4 and illustrates the main parts of the diaphragm pump unit 12. As shown in FIG. 3, the diaphragm pump unit 12 has ink suction mechanisms 20 (liquid replenishing mechanisms) provided on the top of the sub-tanks 11*a* to 11*d* and has a drive mechanism 30 (liquid replenishing mechanism) attached adjacent to the sub-tanks 11*a* to 11*d*. The ink suction mechanisms 20 are used to suction ink from the ink cartridges 9*a* to 9*d* into the sub-tanks 11*a* to 11*d*; the drive mechanism 30 is used to drive the ink suction mechanisms 20.

As shown in FIG. 5, the sub-tank 11*a* (11*b* to 11*d*) has a cylinder 21, which is a tubular form extending in a vertical direction Z. On the bottom of the cylinder 21, an ink chamber 22 (a liquid container chamber) is provided. In order to close the top end of the ink chamber 22, a diaphragm 50 is mounted on the cylinder 21. A support member 23, which is formed like a disk, is mounted to the diaphragm 50. The support member 23 supports, from inside the ink chamber 22, a center region, i.e., a circular area around a tubular portion 51 of the diaphragm 50. A protrusion 23*a* formed in the center of the support member 23 protrudes upward +Z (in a second direction) from the tubular portion 51 provided in the center of the diaphragm 50. A piston 24 that can move inside the cylinder 21 downward −Z (in a first direction) and upward +Z is disposed above the diaphragm 50. The piston 24 is connected through the protrusion 23*a* of the support member 23 to the diaphragm 50.

Each ink suction mechanism 20 has the diaphragm 50, the support member 23, the piston 24, a coil spring 25 (an elastically deformable member) mounted on the top of the piston 24, and a suction lever 26 (i.e., a lever or a drive member) which extends from the top of the coil spring 25 and bends in an L-shape to a side of the cylinder 21. The suction lever 26 is rockably supported on a support shaft 27 located to the rear of the printer from the cylinder 21 and located above the cylinder 21. The suction lever 26 has a first arm portion 26*a* that extends horizontally above the cylinder 21 from the support shaft 27, and a second arm portion 26*b* that extends downward from the support shaft 27. A distal end of the first arm portion 26*a* is formed like a hook; this hook-formed portion locks the top of the coil spring 25. Moreover, a distal end portion 26*c* of the second arm portion 26*b* protrudes away from the cylinder 21.

The suction lever 26 is rocked by an operation of the drive mechanism 30, described later, in a rocking direction A (a specific rocking direction) in which the first arm portion 26*a* is elevated. The suction lever 26 rocks between a lowered position D1 shown by the solid line in FIG. 5 and an elevated position D2 shown by the dashed line. When the first arm portion 26*a* is elevated, the piston 24 connected to the first arm portion 26*a* moves upward +Z to stretch the coil spring 25. Thus, the diaphragm 50 is pulled upward +Z (in the second direction) via the piston 24 and the support member 23 by an elastic restoring force of the coil spring 25. As a result, the volume of the ink chamber 22 is increased, thereby causing a negative pressure state inside the ink chamber 22. Thus, ink is suctioned from the ink cartridge 9*a* (9*b* to 9*d*) to replenish the ink chamber 22 with the ink. Since the check valve 17 is provided on the ink flow path 16*a* (16*b* to 16*d*), which communicates with the pressure adjustment chamber 13*a* (13*b* to 13*d*), backflow of ink from the pressure adjustment chamber 13*a* (13*b* to 13*d*) is stopped while an ink replenishing operation is being performed.

As shown in FIG. 4, the sub-tanks 11*a* to 11*d* are arranged in a line, with the four ink suction mechanisms 20 on the top of the sub-tanks 11*a* to 11*d* also arranged in a line. The drive mechanism 30 has a pressing lever 31 that is disposed in a position facing the distal end portions of the four second arm portions 26*b* that extend in the same direction. The pressing lever 31 is rockably supported on a support shaft 32 that extends along the top end of the lever. Additionally, the drive mechanism 30 has a gear 33, which is formed like a disk, disposed below the pressing lever 31, and a roller 34 that is mounted near the outer periphery region of the gear 33. A worm 36 connected to an output shaft of a motor and a worm wheel 37 engaged therewith are disposed at a position adjacent to the gear 33. The worm wheel 37 becomes engaged with the gear 33. The pressing lever 31, the support shaft 32, the gear 33, the worm 36, the worm wheel 37, and the like constitute a pressing mechanism 38 that presses the second arm portion 26*b* of the suction lever 26 in accordance with an output rotation of the motor.

The output rotation of the motor 35 is transmitted through the worm 36 and the worm wheel 37 to the gear 33 at a predetermined reduction gear ratio. When the gear 33 turns, the roller 34 disposed at the outer periphery of the gear, moves along its arc-like trajectory. The motor 35 is driven in accordance with the output of a sensor 39 that detects the rotational position of the gear 33. This enables the roller 34 to move between a drive position C1 nearest to the suction lever 26 and a retracted position C2 rotated 90 degrees clockwise from the drive position C1.

While moving from the retracted position C2 to the drive position C1, the roller 34 moves a lower end 31*a* of the pressing lever 31 toward the second arm portion 26*b* (in a direction of an arrow B in FIG. 5). As a consequence, the pressing lever 31 presses the distal end portion 26*c* of the second arm portion 26*b* toward the cylinder 21, thereby forcing the suction lever 26 to rock in the rocking direction A. When the roller 34 is held in the drive position C1, the first arm portion 26*a* is held through the pressing lever 31 in the highest elevated position. As described earlier, when the first arm portion 26*a* is elevated, the diaphragm 50 is pulled upward +Z (in the second direction) by use of the coil spring 25 and the piston 24, thereby causing a negative pressure state inside the ink chamber 22. Thus, ink replenishment of the ink chamber 22 is performed.

The diaphragm pump unit 12 has a pressure spring 28 (biasing member) mounted to the top of each piston 24. The pressure spring 28, which is mounted on the outer peripheral side of the coil spring 25, biases the diaphragm 50 downward −Z (in the first direction) by use of the piston 24. When the roller 34 returns to the retracted position C2 on completion of ink replenishment of the ink chamber 22, the suction lever 26 is released from a state in which it is held to a state in which it can rock. As a consequence, the piston 24 can move down. The diaphragm 50 is thus pushed down by use of the piston 24 and the diaphragm 50 is lowered to a position at which the pressure applied by the pressure spring 28 is balanced with the ink pressure applied to the diaphragm 50.

That is, when the suction lever 26 is released from the state in which it is held, as the upward biasing force by the coil spring 25 decreases gradually, the diaphragm 50 becomes downward-biased at a predetermined point through the pressure applied by the pressure spring 28. As a consequence, the diaphragm 50 is lowered and ink suctioned into the sub-tanks 11*a* to 11*d* is pushed into the ink flow paths 16*a* to 16*d* in an amount by which the volume is decreased in response to the diaphragm 50 being lowered. After passing through the check valves 17, the ink is supplied to the pressure adjustment chambers 13*a* to 13*d* of the damper unit 14.

The pressure adjustment chambers 13*a* to 13*d* have a recessed structure, with a predetermined volume, by which its top end is closed with a diaphragm; the diaphragm is biased by a pressure adjustment spring. Ink in the sub-tanks 11*a* to 11*d* is supplied through the pressure adjustment chambers 13*a* to 13*d* to the ink jet head 7. The damper unit 14 can mitigate abrupt changes in ink pressure on the upstream side of the pressure adjustment chambers 13*a* to 13*d* by an elastic restoring force of the pressure adjustment spring.

When the sub-tanks 11*a* to 11*d* are in a negative pressure state by means of operations of the ink suction mechanism 20 and the drive mechanism 30 and ink replenishment of the sub-tanks 11*a* to 11*d* is being performed, ink is not supplied from the sub-tanks 11*a* to 11*d*. Nevertheless, if ink is consumed at the ink jet head 7 during this time, depending upon the negative pressure in the intra-head flow paths 7*a* to 7*d*, the diaphragm of the pressure adjustment chambers 13*a* to 13*d* and the pressure adjustment spring are displaced so that ink in the pressure adjustment chambers 13*a* to 13*d* flows into the intra-head flow paths 7*a* to 7*d*. Namely, in this embodiment, even when ink is not supplied from the sub-tanks 11*a* to 11*d*, with the aid of ink supply from the pressure adjustment chambers 13*a* to 13*d*, the ink jet head 7 can, for a while, continue performing the ink ejecting operation. The volume of the pressure adjustment chambers 13*a* to 13*d* is set so that ink in the pressure adjustment chambers 13*a* to 13*d* is not exhausted during ink replenishment.

Diaphragm

Figure 6A:
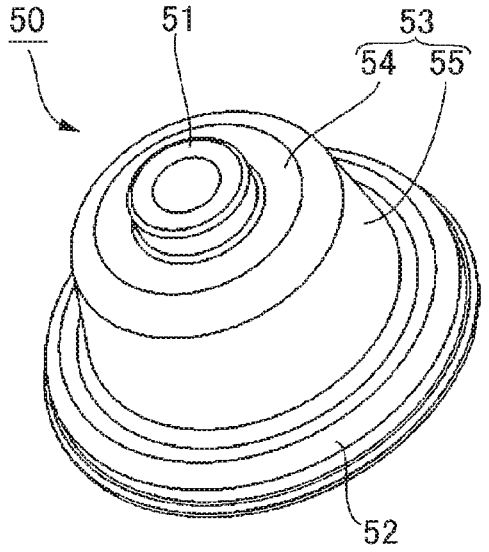
FIGS. 6A and 6B illustrate a diaphragm according to the embodiment.
Figure 6B:
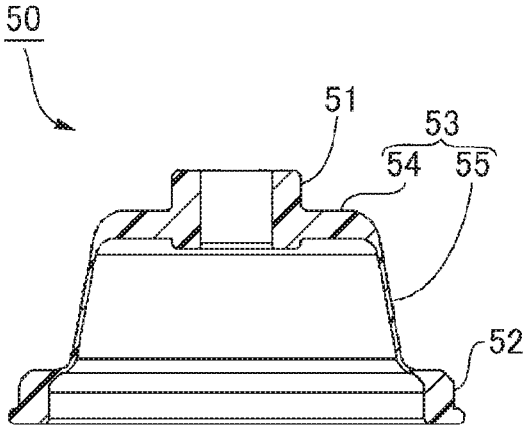

FIGS. 6A and 6B illustrate the diaphragm 50, showing a state in which the diaphragm 50 is removed from the cylinder 21 that constitutes a side wall portion of the sub-tanks 11*a* to 11*d*. FIG. 6A is a perspective view of the diaphragm 50; FIG. 6B is a sectional view of the diaphragm 50. The diaphragm 50, which is made of a resin, has a mounting portion 52 that is secured to the cylinder 21 and a movable portion 53 that moves upward +Z or downward −Z to increase or decrease the volume of the ink chamber 22. As shown in FIG. 5, the cylinder 21 is separated into an upper cylinder 21*a* and a lower cylinder 21*b* on the top end of the ink chamber 22. The mounting portion 52 is a thick portion provided around the entire outer peripheral edge of the diaphragm 50 and is disposed to fit between the bottom end surface of the upper cylinder 21*a* and the top end surface of the lower cylinder 21*b*.

The movable portion 53 has a thick portion 54 (a second portion), which is a circular form, provided in a center region of the diaphragm 50, and a thin portion 55 (a first portion) provided on the outer periphery of the thick portion 54. The mounting portion 52 is provided on the outer peripheral edge of the thin portion 55. In the center of the thick portion 54, the tubular portion 51 is provided to mount the protrusion 23*a* of the support member 23. The thin portion 55 is a flexible membrane; the thick portion 54 is formed so as to be thicker than the thin portion 55. The thick portion 54 is set to be thick enough to retain its flat form, instead of the thick portion 54 expanding upward +Z, even when the ink chamber 22 is pressurized through the pressure applied by the pressure spring 28.

As shown in FIG. 5, with the diaphragm 50 mounted into the cylinder 21, the thick portion 54 extends radially along the surface of the support member 23; the thin portion 55 bends downward −Z to form a projected shape on the outer periphery of the support member 23. A gap to accommodate the thin portion 55 bending downward −Z to form a projected shape is provided between the outer peripheral edge of the support member 23 and the inner circumferential surface of the lower cylinder 21*b*, that is, the inner circumferential surface of the ink chamber 22. With respect to the outer peripheral edge of the radially extending thick portion 54, the thin portion 55 is connected in the form of a bend and extends downward −Z (in the first direction) from the outer peripheral edge of the thick portion 54. Also, with respect to the mounting portion 52 fit into the cylinder 21, the thin portion 55 is connected in the form of a bend and extends downward −Z (in the first direction) from the mounting portion 52. In other words, the diaphragm 50 is configured not to extend upward or radially outward with respect to a direction in which the thin portion 55 extends from the mounting portion 52 and the thick portion 54.

Figure 7A:
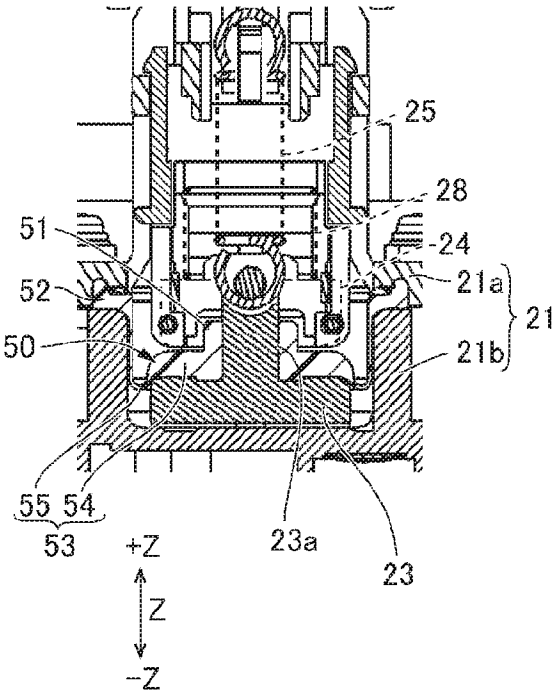
FIGS. 7A, 7B, and 7C illustrate an operation of the diaphragm pump unit.
Figure 7B:
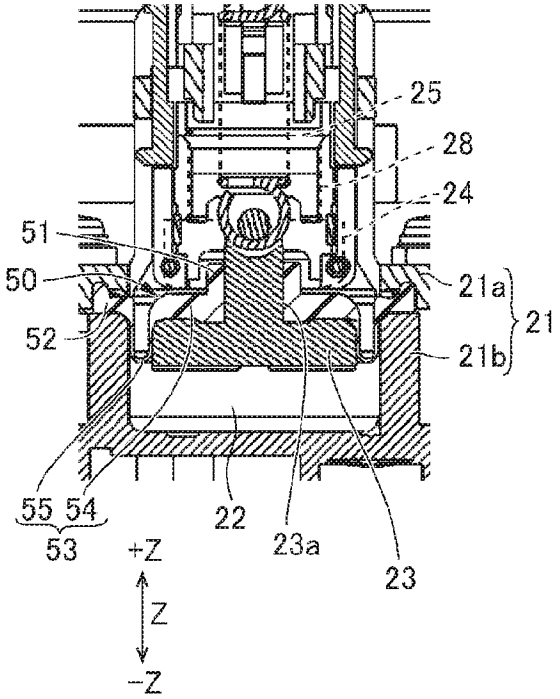
Figure 7C:
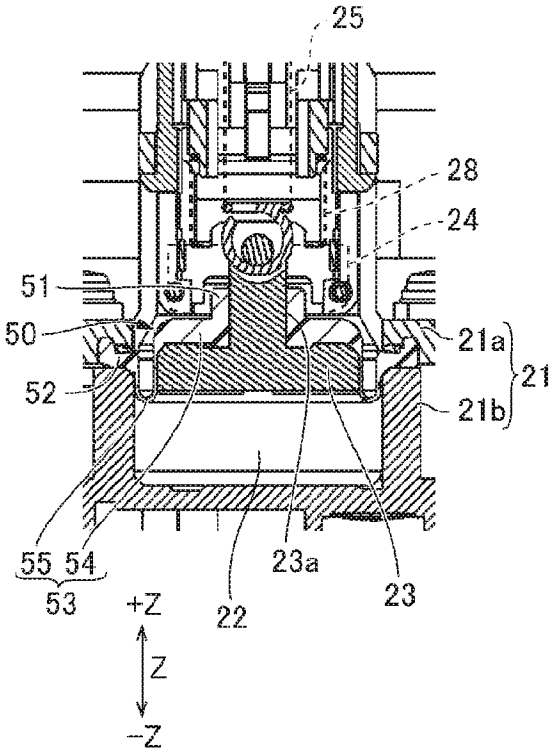

FIGS. 7A, 7B, and 7C illustrate an operation of the diaphragm pump unit 12. FIG. 7A shows a state in which the diaphragm 50 is pulled up by an ink replenishing operation. FIG. 7B shows a state immediately after ink replenishment. FIG. 7C shows a state in which the ink chamber 22 becomes empty after ink supply. When an ink replenishing operation is done by the diaphragm pump unit 12, the diaphragm 50 is pulled upward +Z by use of the piston 24, the support member 23, and the like, as described earlier. The diaphragm 50 is pulled up to a position in which the piston 24 abuts an abutting portion (not shown). FIG. 7A shows this state. Since, during ink replenishment, the ink chamber 22 is in a negative pressure state, the diaphragm 50 sticks to the surface of the support member 23.

Since, immediately after ink replenishment, the suction lever 26 is released from the state in which it is held, as described earlier, the piston 24 and the diaphragm 50 can move down. The diaphragm 50, which is biased downward −Z via the piston 24 by the pressure spring 28, is lowered to a position at which the ink pressure is balanced with the pressure applied, as shown in FIG. 7B. Such lowering causes the ink chamber 22 to have a pressurized state, meaning that pressurized ink can be supplied. In this embodiment, as described earlier, the thick portion 54 of the diaphragm 50 is thick enough not to expand upward +Z even when ink is pressurized. Also, the thin portion 55 is less likely to expand upward +Z or radially outward. Thus, when the ink chamber 22 changes from the negative pressure state to a pressurized state, it is less likely that the diaphragm 50 will be deformed into an unintended shape.

While pressurized ink is being supplied, the thick portion 54 retains its shape as per the support member 23. In addition, the thin portion 55 retains its projected state, in the downward −Z direction, and is deformed according to the piston 24 being lowered. As shown in FIG. 7C, when the ink chamber 22 becomes empty, the support member 23 is lowered to the bottom of the ink chamber 22.

Operations and Advantages

As described above, the ink supply mechanism 19 in this embodiment has the diaphragm pump unit 12 to suction ink from the ink cartridges 9*a* to 9*d* into the sub-tanks 11*a* to 11*d*; the ink suction mechanisms 20 of the diaphragm pump unit 12 have the diaphragm 50 to close one end of the ink chamber 22. The diaphragm 50 has the mounting portion 52 that is secured to the cylinder 21 and has the movable portion 53 that moves upward +Z or downward −Z to increase or decrease the volume of the ink chamber 22. Part of the movable portion 53, i.e., the thin portion 55, is flexible; the thick portion 54 of the movable portion 53 is configured to retain its shape even when the ink chamber 22 is pressurized. Thus, the diaphragm 50 is less likely to be deformed into an unintended shape, and inconveniences due to unintended deformation may not occur. For example, the diaphragm 50 does not expand upward, meaning that the piston 24 is not lowered; this can therefore avoid the reduction in the amount of ink that is suctioned at one time by an ink replenishing operation. Moreover, it is less likely that the diaphragm 50 will bend radially outward or upward; this can reduce the possibility of causing a state in which the diaphragm 50 is lowered in the bent state and is caught between the piston 24 and the cylinder 21.

According to this embodiment, part of the diaphragm 50 is made thick to prevent deformation. By allowing the thin portion 55 to extend downward from the thick portion 54 and the mounting portion 52, the thin portion 55 is less likely to expand upward +Z or radially outward. Thus, this simple yet effective configuration can reduce the possibility of capacity in ink replenishing being decreased or the diaphragm 50 being caught.

According to this embodiment, the diaphragm 50 is supported from inside the ink chamber 22 by the support member 23. When the foregoing support member 23 is provided, the shape of the diaphragm 50 can be stabilized because the diaphragm 50 retains its shape as per the support member 23.

According to this embodiment, the diaphragm 50 is biased downward −Z via the piston 24 by the pressure spring 28 and is pulled upward +Z by the suction lever 26 that is driven by the motor 35. By controlling the drive of the motor 35, ink replenishment can be performed appropriately at a desired timing. Furthermore, pressurized ink can be supplied through the pressure applied by the pressure spring 28.

Modified Example

Figure 8A:
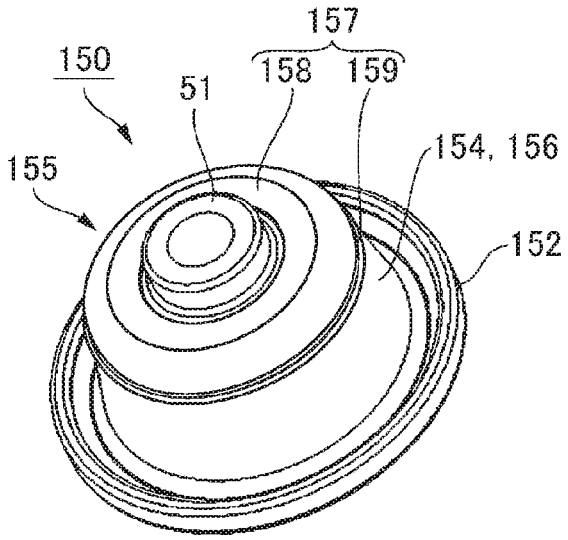
FIGS. 8A and 8B illustrate a modified example of the diaphragm.
Figure 8B:
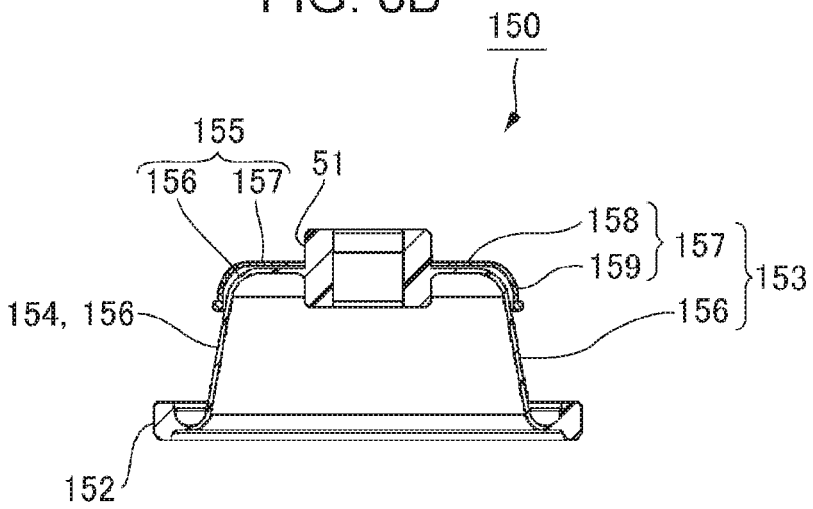

FIGS. 8A and 8B illustrate a diaphragm 150 as a modified example. FIG. 8A is a perspective view of the diaphragm 150; FIG. 8B is a sectional view of the diaphragm 150. In the diaphragm 50 in the above embodiments, part of the movable portion 53 is made thick so as not to be deformed easily. In the modified example, deformation of the diaphragm 150 is prevented by adding a shape-retaining member 157 to a membrane portion made of a resin. Below, like numbers reference like elements of the diaphragm 50 in the above embodiments, and repeated descriptions are omitted; only different elements referenced by different numbers will be described. The diaphragm 150 as the modified example has a mounting portion 152 that is secured to the cylinder 21, and a movable portion 153 that can move upward +Z and downward −Z.

The movable portion 153 has a membrane portion 156, which is flexible, and the shape-retaining member 157 that is mounted to cover the radially inner region of the membrane portion 156 from above. The membrane portion 156 has the same thickness as the thin portion 55 in the above embodiments and has the tubular portion 51 provided in the center thereof. The shape-retaining member 157 has an annular portion 158 that surrounds the tubular portion 51 and extends annularly in the direction of the radius, and a rim portion 159 that bends downward −Z from the outer peripheral edge of the annular portion 158. That is, the radially inner region of the movable portion 153 in the modified example is a second portion 155 which has a double structure by which the membrane portion 156 is covered with the shape-retaining member 157. The outer periphery region of the second portion 155 is a first portion 154 composed of the membrane portion 156 only.

Figure 9C:
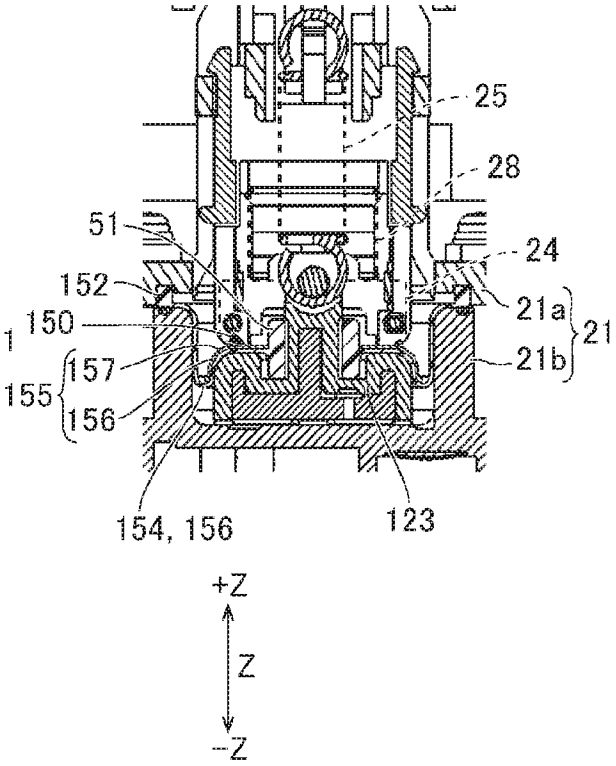
FIGS. 9A, 9B, and 9C illustrate an operation of a diaphragm pump unit employing the modified example of the diaphragm.
Figure 9B:
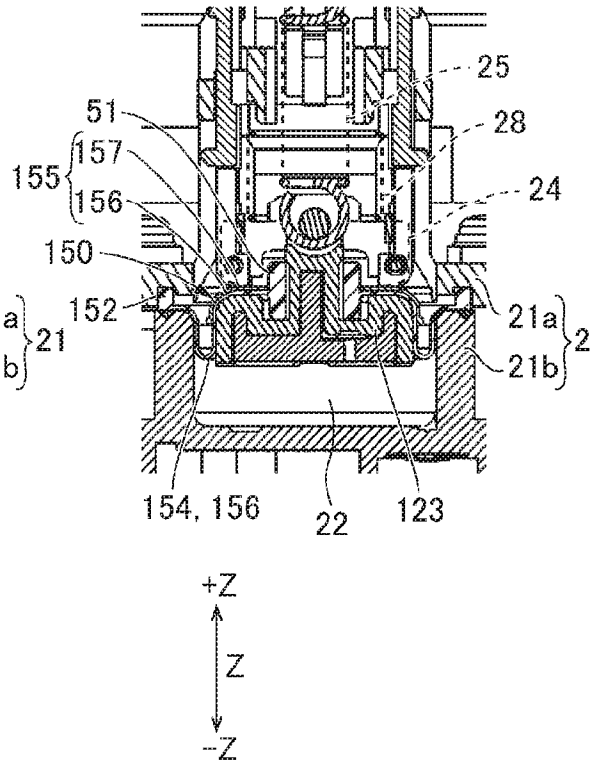
Figure 9A:
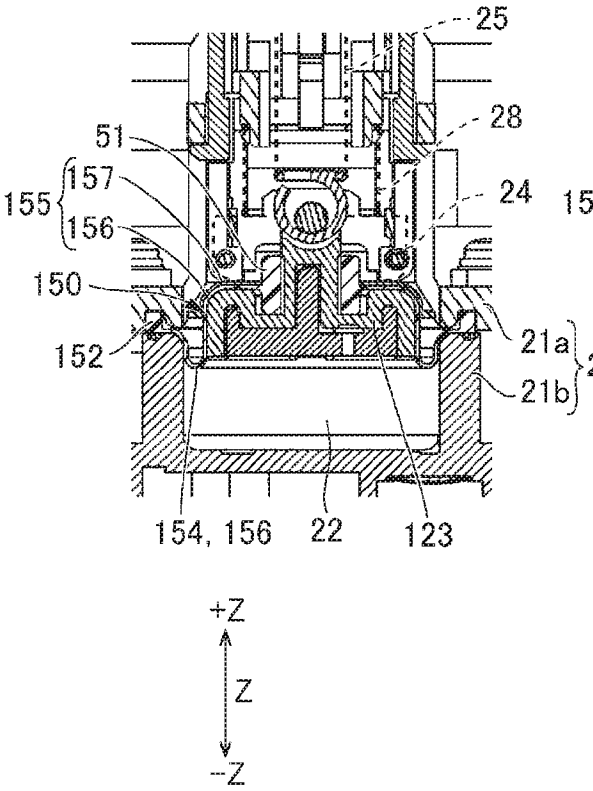

FIGS. 9A, 9B, and 9C illustrate an operation of a diaphragm pump unit 112 employing the diaphragm 150 as the modified example. FIG. 9A shows a state in which the diaphragm 150 is pulled up by an ink replenishing operation. FIG. 9B shows a state immediately after ink replenishment. FIG. 9C shows a state in which the ink chamber 22 becomes empty after ink supply. As shown in FIG. 9A, the second portion 155 of the diaphragm 150 as the modified example is supported from the downside by a support member 123. In the shape-retaining member 157, the annular portion 158 extends radially along the upper surface of the support member 123; the rim portion 159 bends downward along the outer peripheral edge of the support member 123. The radially inner region of the membrane portion 156 extends along a gap between the shape-retaining member 157 and the support member 123 and extends downward −Z from the lower end of the rim portion 159 of the shape-retaining member 157.

As shown above, in the diaphragm 150 as the modified example, the second portion 155 has the shape-retaining member 157. Even when the ink chamber 22 is pressurized by an ink replenishing operation, the second portion 155 can therefore retain its shape because its deformation is restricted. Thus, as is the case in the above embodiments, it is less likely that the diaphragm 150 will expand upward or radially outward, leading to a reduction in the amount of ink that is suctioned, or that a state of the diaphragm 150 being caught will occur.

Other Embodiments

The above embodiments are exemplary applications of the invention to the ink jet printer 1 and its ink supply mechanism 19 that supplies ink to the ink jet head 7; the invention can be applied to other types of liquid ejecting apparatuses and liquid supply mechanisms that eject liquid other than ink. For example, the invention can be applied to a liquid ejecting apparatus that ejects a reagent solution, a fluid sample, or the like from a liquid ejection head or can be applied to a liquid ejecting apparatus that ejects from a liquid ejection head a wet coating or a fluid material to apply by printing.

The entire disclosure of Japanese Patent Application No. 2015-206142, filed Oct. 20, 2015 is expressly incorporated by reference herein.

What is claimed is:

1. A liquid supply mechanism comprising:

a sub-tank that supplies liquid to a liquid ejection head; and a liquid replenishing mechanism that suctions liquid from a main tank into the sub-tank;

wherein the liquid replenishing mechanism includes a diaphragm that closes one end of a liquid container chamber provided on the sub-tank, a biasing member that biases the diaphragm in a first direction in which a volume of the liquid container chamber is decreased, and a drive member that pulls the diaphragm in a second direction in which the volume of the liquid container chamber is increased;

wherein the diaphragm has a movable portion that is movable in the first direction and in the second direction, and a mounting portion secured to the sub-tank, wherein the movable portion has a first portion, being flexible, and a second portion, at least a portion of which retains its shape when the liquid container chamber is pressurized, wherein the second portion has a membrane portion, being flexible, and a shape-retaining member that covers the membrane portion.

2. The liquid supply mechanism according to claim 1, wherein at least a portion of the second portion is a thick portion that is thicker than the first portion.

3. The liquid supply mechanism according to claim 2, wherein the thick portion is provided in a center region of the diaphragm and the first portion extends in the first direction from an outer peripheral edge of the thick portion.

4. The liquid supply mechanism according to claim 1, wherein the liquid supply mechanism includes a support member that supports the center region of the diaphragm from inside the liquid container chamber, the second portion extends along a surface of the support member, and a gap to accommodate the first portion, the first portion being loosened to form a projected shape in the first direction, is provided between the outer peripheral edge of the support member and an inner circumferential surface of the sub-tank.

5. The liquid supply mechanism according to claim 1, wherein the liquid replenishing mechanism has a piston connected to the diaphragm and has an elastically deformable member that interconnects between the piston and the drive member, the biasing member is a pressure spring that biases the diaphragm in the first direction by use of the piston, and the drive member is a lever capable of rocking in a specific rocking direction in which the lever pulls the diaphragm in the second direction by use of the piston and the elastically deformable member and in a direction opposite thereto.

6. The liquid supply mechanism according to claim 5, wherein the liquid replenishing mechanism has a motor and a pressing mechanism that presses the lever in the specific rocking direction in accordance with an output rotation of the motor.

7. A liquid ejecting apparatus comprising:

a liquid supply mechanism according to claim 1; and a liquid ejection head that ejects liquid supplied from the liquid supply mechanism.

* * * * *